US005097099A

United States Patent [19]

Miller

[11] Patent Number: 5,097,099

[45] Date of Patent: Mar. 17, 1992

[54] HYBRID BRANCH CABLE AND SHIELD

[75] Inventor: Vernon R. Miller, Atlanta, Ga.

[73] Assignee: AMP Incorporated, Harrisburg, Pa.

[21] Appl. No.: 638,943

[22] Filed: Jan. 9, 1991

[51] Int. Cl.[5] ..... H01B 7/08; H01B 7/34

[52] U.S. Cl. ..... 174/36; 174/115; 174/117 F; 174/117 M; 439/422; 439/498

[58] Field of Search ..... 174/36, 115, 117 F, 174/117 FF, 117 M, 107; 439/422, 498

[56] References Cited

U.S. PATENT DOCUMENTS

| | | | |
|---|---|---|---|
| 3,934,075 | 1/1976 | Dilliplane | 174/36 X |
| 4,096,346 | 6/1978 | Stine et al. | 174/36 |
| 4,492,815 | 1/1985 | Maros | 174/36 X |
| 4,533,790 | 8/1985 | Johnston et al. | 174/115 |
| 4,560,224 | 12/1985 | Weisenburger | 439/422 |
| 4,719,319 | 1/1988 | Tighe, Jr. | 174/115 X |
| 4,767,891 | 8/1988 | Biegon et al. | 174/36 |
| 4,857,381 | 8/1989 | Suzuki | 174/36 X |
| 4,997,388 | 3/1991 | Dale et al. | 439/404 |

FOREIGN PATENT DOCUMENTS

| | | | |
|---|---|---|---|
| 45010 | 2/1989 | Japan | 174/36 |
| 9008388 | 7/1990 | PCT Int'l Appl. | 174/115 |
| 2176926 | 1/1987 | United Kingdom | 174/117 F |

*Primary Examiner*—Morris H. Nimmo
*Attorney, Agent, or Firm*—William B. Noll

[57] ABSTRACT

The present invention is directed to a strong, flexible composite shielding member to provide electromagnetic interference (EMI) shielding between power conductors and signal conductors for use in an electrical transmission system, such as a bundled hybrid cable. A preferred shield member comprises a flat dielectric central laminate having on each major surface thereof a metallic, electrically conductive film, where the core includes a plurality of longitudinally arranged strengthening members, such as fiberglass strands.

14 Claims, 6 Drawing Sheets

HYBRID BRANCH CABLE AND SHIELD

BACKGROUND OF THE INVENTION

The present invention is directed to a bundled hybrid ribbon cable, particularly to the unique shielding member therein to provide electro-magnetic interference (EMI) shielding between the power conductors and signal conductors, which conductors are typically aligned in parallel fashion within the ribbon cable.

In an effort to improve the electrical system and capabilities of newly constructed homes, for example, particularly in the use of built-in communication, alarm and entertainment systems, it was necessary to develop a hybrid branch cable that included both power conductors and signal or data conductors, the latter for controlling the system.

The signal wires are separate from the 60 hertz 110 volt power conductors present in the same cable. In U.S. Pat. application, Ser. No. 07/298,528 there is disclosed a configuration in which a plurality of signal conductors are included in the same bundle cable with 110 volt 60 hertz power conductors. That configuration employed a specific bundling configuration in an attempt to reduce the interference between the 60 hertz power conductors and the data conductors or signal conductors. However, that configuration proved inadequate to shield power conductors from radiated and conducted emission. Therefore, it became clear that some shielding means or mechanism was necessary between the conductors, and further to protect against external conductive and radiated emissions.

It was further discovered that to render a bundled cable a viable alternative to a plurality of discrete wires, means had to be found to terminate the cable to a convenience center outlet forming the access means to the system. U.S. Pat. application, Ser. No. 07/400,315 discloses a cable tap configuration used with a cable of the type depicted in copending application Ser. No. 07/298,528. However, copending application Ser. No. 07/400,315 only discloses a cable tap configuration for establishing electrical connections to power and signal conductors in a bundled ribbon cable. No provision is made for use whereof this cable tap with a cable, where such cable employs a shield extending along the length of the cable.

In actual practice, this cable must be installed within a house and at a certain location a splice must be made between two sections of the cable. The most advantageous location for such a splice is at the individual convenience centers where access can easily be had to the cable. In U.S. Pat. application, Ser. No. 07/532,463 there is disclosed a splice configuration for use with hybrid bundled cable. However, that development does not show any means for using that cable tap and the cable clamp with a cable having a shield.

It was not until the present invention that a means was found to provide the necessary shielding, whereby one could effectively employ a bundled hybrid cable. The features of this invention will become more apparent from the description which follows.

SUMMARY OF THE INVENTION

The present invention is directed to a strong, flexible composite shielding member to provide electromagnetic interference shielding between power conductors and signal conductors for use in an electrical transmission system, such as a bundled hybrid cable. A preferred shield member comprises a flat dielectric central core, preferably in the form of a laminate, having on each major surface thereof a metallic, electrically conductive film, where said laminate is further provided with longitudinally oriented strengthening members, such as fiberglass strands.

In use, such shielding member is wrapped around the plural signal conductors whereupon the assembly is folded into a generally circular arrangement, then encased within a dielectric wrap. Thus, the present invention shows a means for including a shield within hybrid cable configuration so that the shield protects the high frequency data wires from electro-magnetic interference, but at the same time the shield can easily be separated from the conductors and the integral ribbon cable contained within the bundled cable. This allows for easy termination to a convenience center outlet, and for splicing together severed shielding members.

DETAILED DESCRIPTION OF PREFERRED EMBODIMENTS

Figure 1:
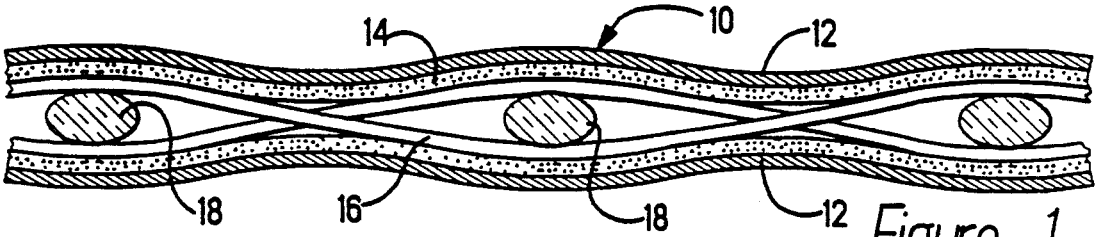
FIG. 1 is an enlarged sectional view of a flat, flexible, composite shielding member for use in providing electromagnetic interference (EMI) shielding between power and data conductors of an electrical transmission system, in accordance with this invention.

The present invention relates to a strong, flexible composite shielding member to provide electro-magnetic interference (EMI) shielding between power conductors and signal conductors in a bundled cable system. FIG. 1 illustrates in a simple schematic form a sectional view of a preferred shielding member 10 according to this invention.

Figure 2:
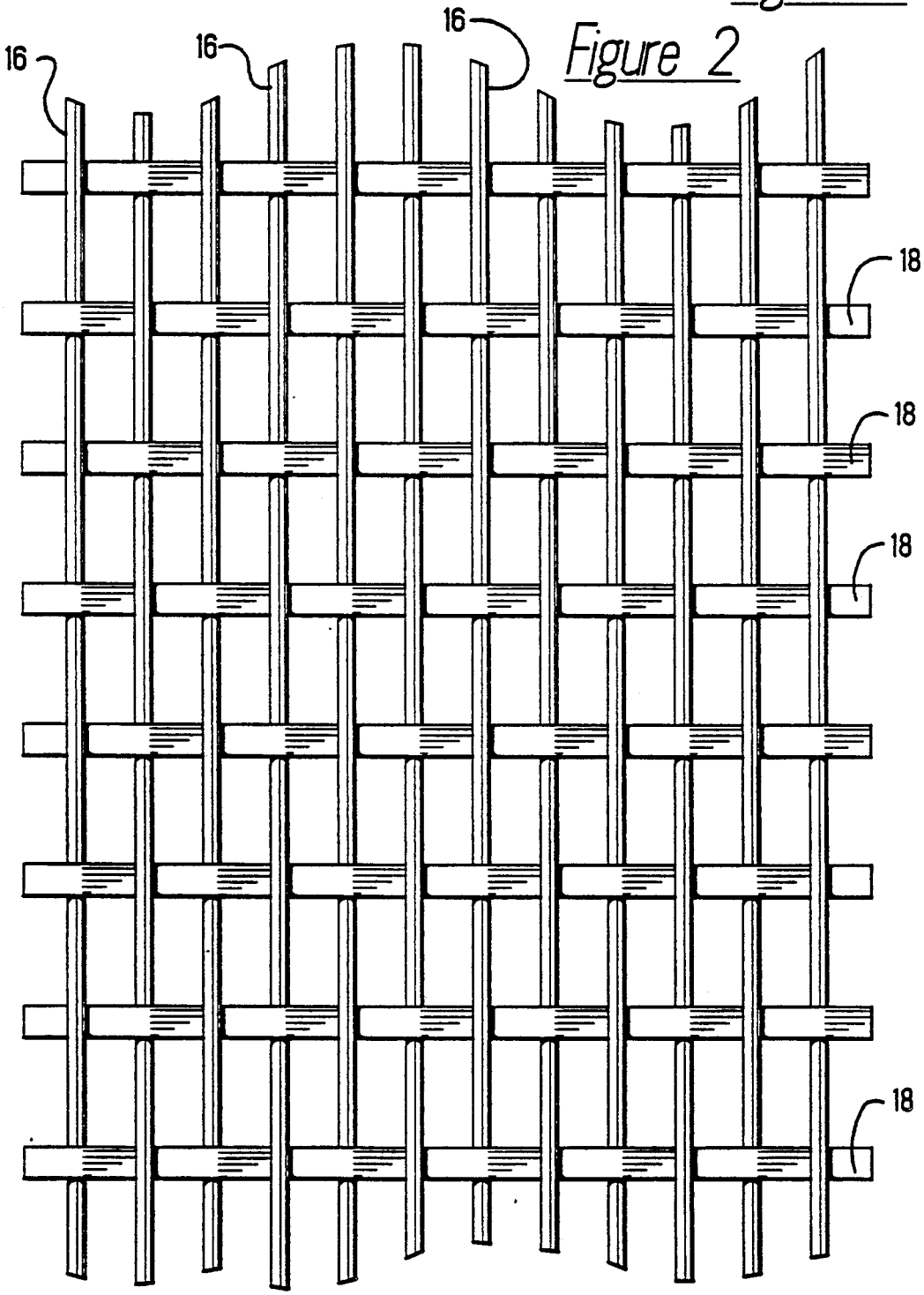
FIG. 2 is a plan view of the central laminate or layer of the flexible shielding composite member prior to fabricating said composite member.

The shielding member 10 comprises a pair of outer planar, electrically conductive foil members 12, such as aluminum or copper foil, and a flat, sheet-like inner fiberglass scrim 16 and 18 for strength, bonded to the pair of planar foil members with adhesive 14. The scrim, a plan view of which is shown in FIG. 2, comprises a majority (at least 10 to 15 strands per inch) of longitudinal parallel fiberglass strands 16 and a minority (only 2 or 3 strands per inch) of cross fiberglass strands 18. The parallel longitudinal fiberglass strands 16 provide the strength while the cross fiberglass strands 18 primarily hold the scrim together in proper spacing during fabrication. In such preferred embodiment, a typical foil thickness is about one mil, with an overall thickness of about 8 mils, where the scrim and adhesive to secure the foil members comprise the major portion of the composite.

An important characteristic of bundled cable is that it must possess relatively high strength and flexibility. This is especially true of the shield. High strength and flexibility in the shield is necessary because this cable, although relatively stiff, must be pulled through holes in studs in a house, much in the same manner as conventional non-metallic cable. Since this cable, a typical ribbon cable being illustrated in FIG. 4, contains additional signal conductors, it is stiffer than conventional non-metallic power cable. Therefore, the addition of the shield should not add to the stiffness of the cable. Furthermore, the addition of the shield should increase the tensile strength of the cable, to assist in preventing damage to the relatively weak signal conductors because of the tensile stresses imposed as the cable is pulled. By the unique construction of the shield hereof, the tensile strength of the bundled cable is enhanced. In addition to strength, desired attributes of the shield are resistance to knotting, and tearing when notched or edge cut.

Figure 3:
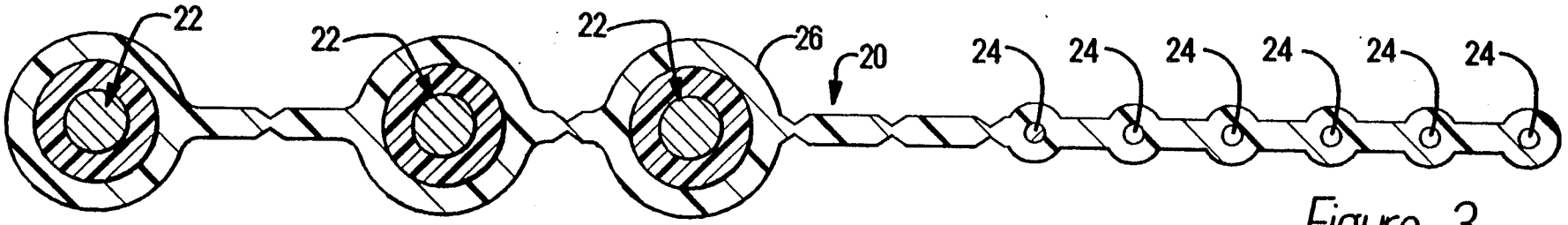
FIG. 3 is a sectional view of an exemplary electrical transmission system, or flat multiconductor cable, as used by this invention, where such system contains plural power conductors and plural data or signal conductors.
Figure 4:
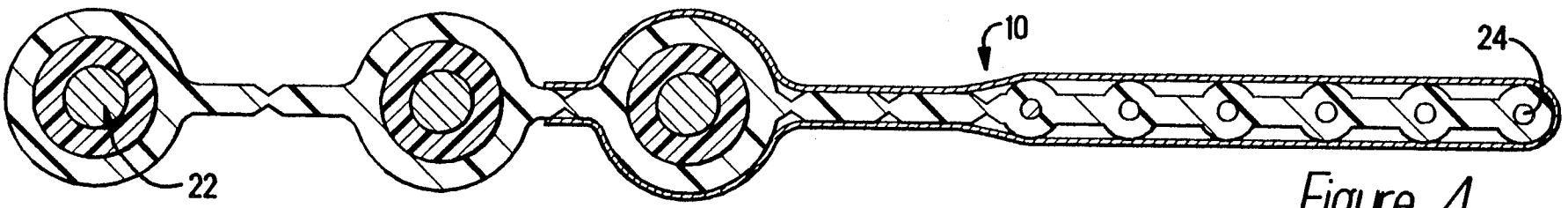
FIG. 4 is a sectional view showing the initial placement of the composite shielding member about the plural signal conductors.
Figure 5:
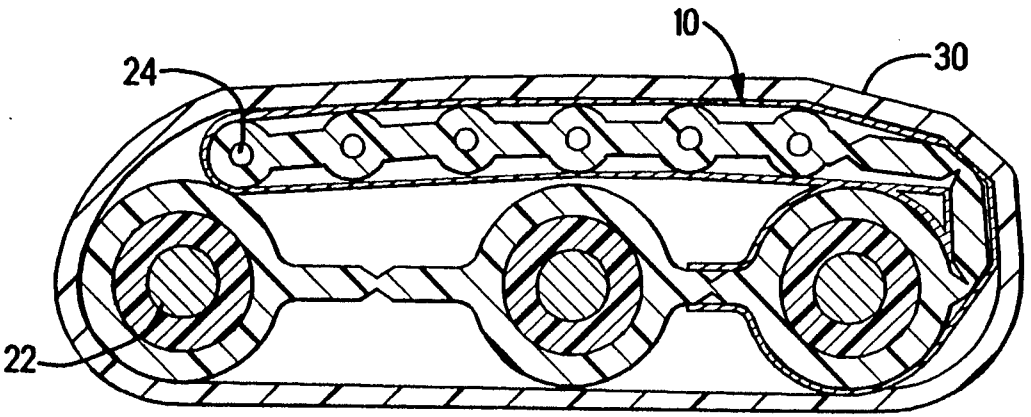
FIG. 5 is a sectional view of a folded and assembled electrical transmission system, ensheathed within a dielectric wrap, i.e. bundled, where the composite shielding member is positioned to provide EMI shielding between plural power conductors and plural signal conductors, in the manner taught by this invention.

FIGS. 3–5 illustrate the general steps in fabricating a bundled hybrid cable, with shield, as taught by this invention. In FIG. 3, there is shown a flat ribbon cable 20, as known in the art, containing plural power conductors 22 and plural signal or data conductors 24. Such conductors, arranged generally in parallel relationship, are joined by a common insulation sheath 26. For purposes of illustration, a typical ribbon cable 20, such as shown in FIG. 3, may comprise three power conductors consisting of a hot, ground, and neutral wires, and six data conductors to control various sub-systems.

FIG. 4 is a view similar to FIG. 3, but showing the shielding member 10 wrapped around the plural signal conductors 24. That is, the shielding member is positioned within the hybrid ribbon cable by folding the shield about a longitudinal fold line and placing one side of that shield adjacent the signal conductors up to and around at least one of said power conductors. The other side of the shield extends around the exterior of the signal conductors. Thus, the signal conductors are enclosed around substantially the entire circumference of that portion of the cable. Thereafter, the assembly of FIG. 4 is folded to make it more compact into a generally circular configuration, whereupon an outer sheath 30 such as PVC, is provided, see FIG. 5. By this arrangement, with the shielding member 10 in place, the signal conductors 24 are shielded from the power conductors 22.

Figure 6:
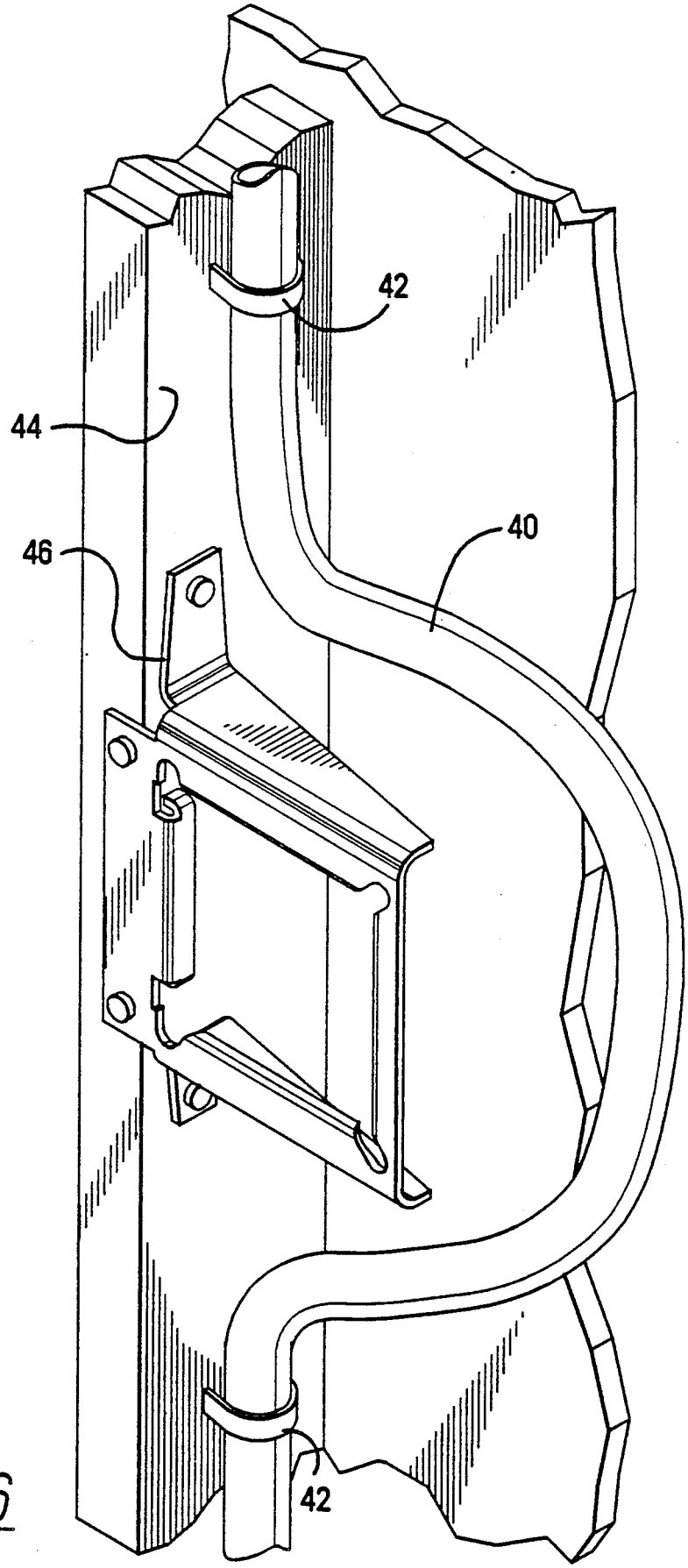
FIG. 6 is a perspective view of an endless, bundled, electrical transmission system, adjacent a mounted electrical convenience center bracket prior to termination of individual conductors from said system.
Figure 7:
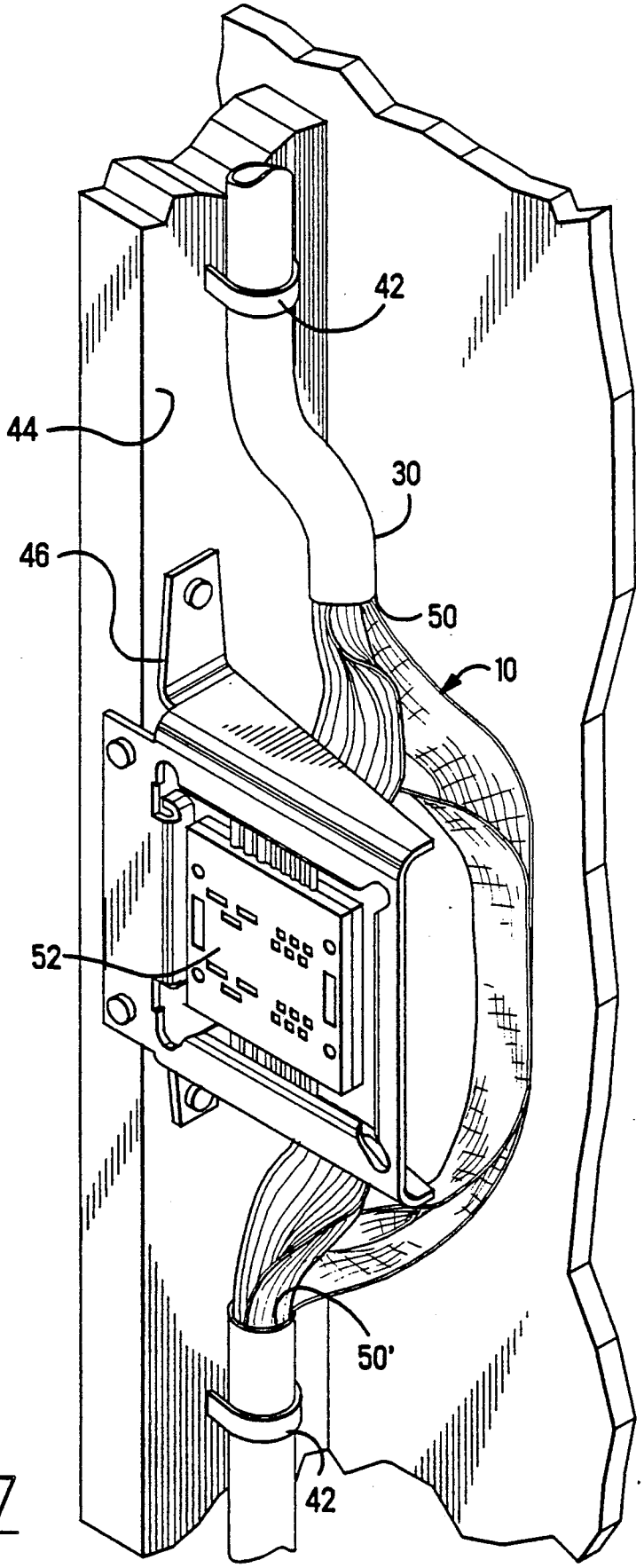
FIG. 7 is a perspective view similar to FIG. 6 but showing a mounted electrical convenience center outlet, with individual conductors from the bundled, electrical transmission system terminated thereto, and the shielding member routed therebehind.

FIGS. 6 and 7 illustrate the manner by which the bundled cable of this invention may be used in home construction, for example. In FIG. 6, there is shown a section of bundled cable 40 stapled 42, to a stud 44 on opposite sides of a convenience center bracket 46. This cable section has a loop formed between the two locations in which it is secured to the stud. FIG. 6 shows that this cable can be positioned in this manner when the cable is initially pulled and positioned within a wood frame structure of conventional construction, prior to erection of the drywall in the structure.

Prior to termination, a section of the outer wrap or sheath 30 must be removed. This may be accomplished by removing the outer sheath 30 from a section of the cable adjacent each location in which a cable tap is to be attached to the cable. This sheath can be removed by longitudinally slitting the outer sheath and then cutting away this outer sheath at two spaced apart locations 50,50' (see FIG. 7). The flat ribbon cable, which is initially in a folded or bundled configuration, can then be flattened in that section of the cable from which the sheath has been removed. Prior to flattening this cable, the shield, which is also in a folded configuration, is removed from its initial position in which a portion of this flat shield separates the data conductors from the larger gauge power conductors.

The conductors in the flat ribbon cable may then be terminated to a hybrid branch cable tap 52, while the shielding member 10 is deployed on the rear of the terminated assembly, see FIG. 7.

Figure 8A:
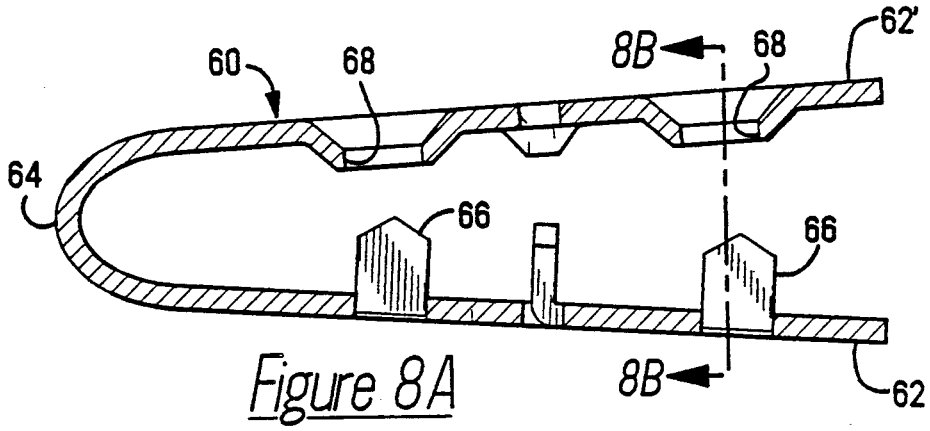
FIG. 8*a* is an enlarged sectional view of a typical splicing member as may be used herein to effect splicing between overlaping shielding members according to this invention.

It may be necessary or desirable to cut and sever the shielding member 10. In such situation the unique construction of the shielding member 10 allows for splicing in a manner that retains the strength and integrity of such member. That is, by the preferred use of a shielding member comprising outer layers of a conductive material, such as an aluminum foil, bonded to an integral layer including a plurality of longitudinally extending fiber glass strands, exceptional strength and notch resistance is achieved, as more fully explained hereinafter. Splicing of the shielding member 10 may be accomplished by the use of a metallic, V-shaped member as illustrated in FIG. 8*a*, or alternatively as illustrated and described in U.S. Pat. No. 4,560,224, assigned to the assignee hereof. FIG. 8*a* shows a suitable splicing member 60 characterized by a pair of arms 62,62' joined by a web portion 64. One of said arms, arm 62, for example, is provided with one, and preferably more, lances 66 directed inwardly toward the outer arm 62'. Said other arm 62' is provided with a corresponding number of aligned, lance receiving openings 68, one each to receive a lance 66. Thus, in closing the splicing member 60, i.e. bringing the arms 62,62' toward one another, with the shielding member 10 therewithin, the lances 66 are caused to penetrate such shielding member and enter into their corresponding openings 68. By this operation, the penetrating lances 66 are caused to interact with and hold the strands 16,18 of the fiberglass scrim.

Figure 8B:
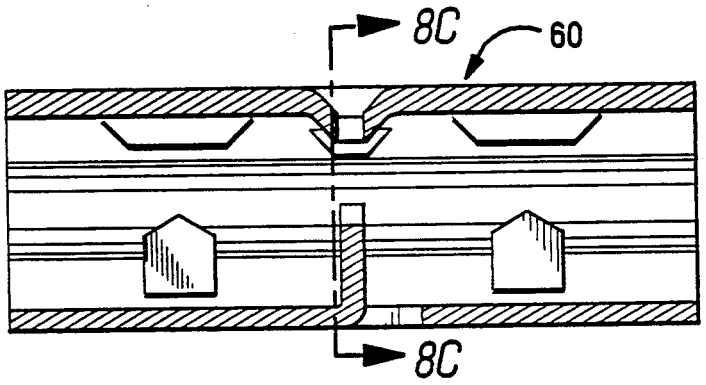
FIG. 8*b* is an enlarged sectional view of two shielding members, as taught herein, on which two splicing members, as illustrated in FIG. 8*a*, are employed.
Figure 8C:
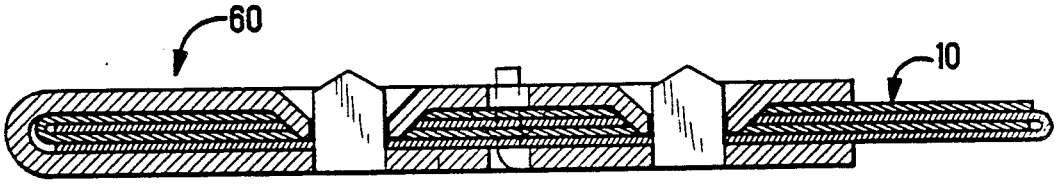
FIG. 8*c* is an enlarged sectional view taken along line 8*c*–8*c* of FIG. 8*b*.
Figure 9:
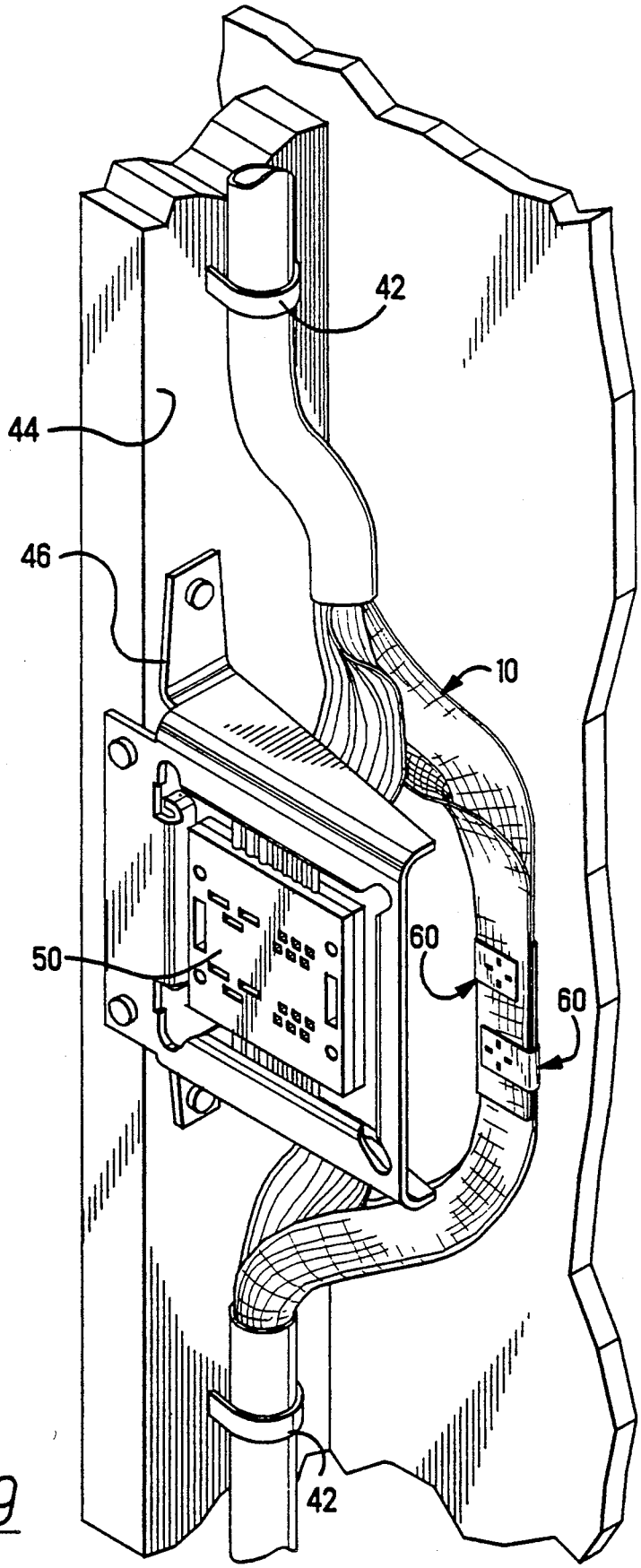
FIG. 9 is a perspective view similar to FIG. 7, but showing a splice effected in the shielding members.

In the practice of this invention, a pair of shielding members 10 are folded along a longitudinal axis thereof and interlocked in a manner as shown in the sectional view of FIG. 8*c*. In a preferred practice of this invention, two splicing members 60, applied from opposite sides as shown in FIG. 8*b*, are brought into engagement with the interleaved shielding member 10 and clamped, such as by the application of a crimping tool thereto. While this results in formally splicing such shielding members 10 together, it also cuts into and severs isolated locations along the scrim. FIG. 9 shows a formal splice as it may appear in the wiring of a construction project.

Recognizing that splicing may be a necessary consequence on the use of the cable hereof, a series of tests were conducted to show the significant level of strength remaining in a shielding member where certain of the support strands were damaged. For such tests, two 0.001" thick dead soft aluminum foils were adhered to a fiberglass scrim, where such scrim had from 10 to 15 longitudinally arranged strands per inch, and 5 strands per inch in the horizontal direction. The results thereof are presented in Table I.

TABLE I

| SAMPLE | TENSILE BREAK STRENGTH - lbs (foil) | TENSILE BREAK w/.5" EDGE CUT STRENGTH - lbs | TENSILE BREAK STRENGTH SPLICE - lbs |
|---|---|---|---|
| A | 232 | | |
| B | 228 | | |
| C | | 123 | |
| D1 | | | 75 |
| D2 | | | 84 |
| E | | | 77 |

Sample Thickness (Five Points Avg.) 6.9 mils
All tensile strength tests are done with .5"/min head rate.
Sample A and B are the 2" wide composite.
Sample C is 2" wide composite with .5" edge cut.
Sample D1 and D2 are spliced with one double splice and tensile test was done with the composite folded in half.
Sample E is spliced with two single splices, and folded for tensile test.

It is significant from the data of Table I that even where the shielding member was cut to 25% of its width, the integrity of said member remained high.

I claim:

1. An electrical transmission system comprising power conductors and signal conductors, and a strong, flexible composite shielding member providing electromagnetic interference shielding between said power conductors and said signal conductors, where said shielding member comprises a flat dielectric central laminate having on each major surface thereof a metallic, electrically conductive film.

2. The electrical transmission system according to claim 1 wherein said electrical transmission system comprises a plurality of power conductors, and a plurality of signal conductors arranged in side-by-side, parallel relationship.

3. The electrical transmission system according to claim 1 wherein said flat dielectric central laminate contains a plurality of strand-like strength members.

4. The electrical transmission system according to claim 3 wherein certain of said strength members are arranged in a first direction within the plane of said central laminate, and the remaining strength members are arranged essentially perpendicular thereto.

5. The electrical transmission system according to claim 1 wherein said metallic, electrically conductive film is selected from the group consisting of copper and aluminum foil.

6. The electrical transmission system according to claim 3 wherein said strand-like strength members are strands of fiberglass.

7. An electrical cable comprising a plurality of electrical conductors and a shield member extending along the length of the cable, the shield member comprising a central laminate member including a plurality of separate, parallel longitudinally extending nonconductive strands, and continuous conductive means adhesively bonded to each side of said central laminate member.

8. An electrical cable comprising a plurality of electrical conductors and a shield member extending along the length of the cable, the shield member comprising a central laminate member including a plurality of separate, parallel longitudinally extending nonconductive strands and continuous conductive aluminum foil on each side of said central laminate member.

9. The electrical cable of claim 8 wherein a plurality of the electrical conductors are disposed within a common insulative web, the web being folded about a major axis with at least a portion of the shield member being disposed between folded sections of the insulative web.

10. The combination of a pair of planar shielding members arranged in overlapping relationship, where said shielding members are adapted to provide electromagnetic interference shielding between plural power conductors and plural signal conductors in an electrical transmission system, and each shielding member comprises a flat dielectric central laminate having on each major surface thereof a metallic, electrically conductive film, and a metallic splicing member having a generally V-shaped configuration formed by a pair of arms and adapted to receive the overlapping shielding members between said arms, where at least one said arm is provided with at least one inwardly directed lance, whereupon on closing said splicing member the at least one lance is caused to penetrate each said shielding member to effect a strong splice between said shielding members.

11. The combination according to claim 10 wherein said central laminate contains a plurality of strand-like strength members, and that said at least one lance interacts with at least one of said strand-like strength members to maintain the strength and integrity of the spliced shielding members.

12. The combination according to claim 11 wherein certain of said strength members are arranged in a first direction within the plane of said central laminate and the remaining strength members are arranged essentially perpendicular thereto.

13. The combination according to claim 12 wherein said strength members are strands of fiberglass.

14. The combination according to claim 11 wherein each said shielding member is folded along a longitudinal axis, and that said shielding members are interlocked in overlapping relationship prior to closing said splicing member.

* * * * *